US008819973B2

(12) United States Patent
Mochel

(10) Patent No.: US 8,819,973 B2
(45) Date of Patent: Sep. 2, 2014

(54) FRONT LOADING FRAME ON RAIL DISPLAY SYSTEM

(76) Inventor: Howard Grayston Mochel, Pasadena, CA (US)

( * ) Notice: Subject to any disclaimer, the term of this patent is extended or adjusted under 35 U.S.C. 154(b) by 12 days.

(21) Appl. No.: 13/573,390

(22) Filed: Sep. 13, 2012

(65) Prior Publication Data

US 2014/0068984 A1 Mar. 13, 2014

(51) Int. Cl.
*A47G 1/06* (2006.01)

(52) U.S. Cl.
CPC ..... *A47G 1/06* (2013.01)
USPC ..... 40/700; 40/785; 40/782

(58) Field of Classification Search
USPC ..... 40/730, 761–764, 780, 745; 403/DIG. 12; 411/142, 340, 346, 351
See application file for complete search history.

(56) References Cited

U.S. PATENT DOCUMENTS

| | | | | | |
|---|---|---|---|---|---|
| 2,540,221 | A * | 2/1951 | Ten Hoeve et al. | ..... | 40/661 |
| 3,722,122 | A | 3/1973 | Sesto | | |
| 3,878,633 | A | 4/1975 | McWilliams | | |
| 4,211,372 | A * | 7/1980 | Zapomel | ..... | 242/899 |
| 4,879,824 | A * | 11/1989 | Galloway | ..... | 40/763 |
| 5,343,642 | A * | 9/1994 | Magnusson | ..... | 40/762 |
| 5,365,683 | A * | 11/1994 | Borja | ..... | 40/781 |
| 5,403,109 | A * | 4/1995 | Johnson et al. | ..... | 403/231 |
| 5,617,660 | A * | 4/1997 | Pollack | ..... | 40/606.17 |
| 6,374,523 | B1 * | 4/2002 | Smith | ..... | 40/611.06 |
| 6,705,034 | B1 | 3/2004 | Cahill | | |
| 6,908,252 | B1 * | 6/2005 | Rubano | ..... | 403/231 |
| 6,939,075 | B2 * | 9/2005 | Walz | ..... | 403/231 |
| 6,962,017 | B1 * | 11/2005 | Pounds | ..... | 40/781 |
| 7,028,425 | B2 | 4/2006 | Lasher | | |
| 7,055,275 | B1 | 6/2006 | Teza et al. | | |
| 7,363,739 | B2 | 4/2008 | Dalsey et al. | | |
| 7,386,951 | B2 | 6/2008 | Bartholomew | | |

FOREIGN PATENT DOCUMENTS

| | | |
|---|---|---|
| DE | 29903342 | 6/1999 |

* cited by examiner

*Primary Examiner* — Joanne Silbermann
*Assistant Examiner* — Christopher E Veraa
(74) *Attorney, Agent, or Firm* — John C. McMahon

(57) ABSTRACT

A front loading frame on rail display system includes a support rail assembly secured to a wall and a display frame assembly secured to the support rail. The rail assembly includes a wall rail secured to the wall with a top rail secured thereto and receiving an apron crown molding. The frame assembly includes a frame unit formed by top and side frame members and closed by a back panel. The frame members have notched glass clips which are aligned in a plane. Display materials are front loaded into the frame unit, and a glass pane is slid into the clips. Fasteners extending from the side frame members are received in rotary lock members positioned in the top rail. The lock members are rotated to lock positions to engage heads of the fasteners to removably secure the frame assembly to the rail assembly.

23 Claims, 3 Drawing Sheets

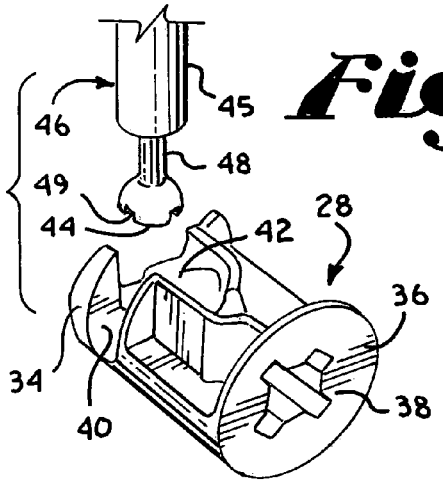
Fig. 5.
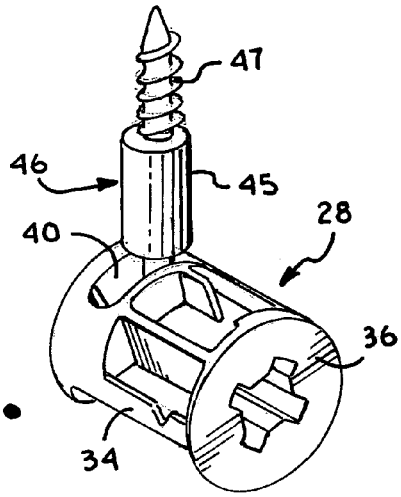
Fig. 6.
Fig. 7.
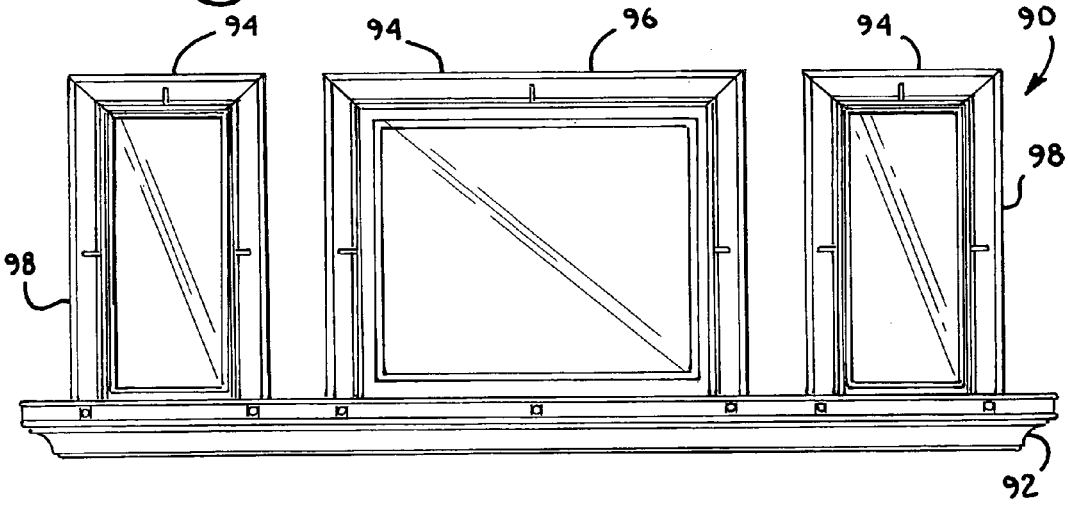

FRONT LOADING FRAME ON RAIL DISPLAY SYSTEM

BACKGROUND OF THE INVENTION

The present invention is broadly concerned with improvements in display framing and, more particularly, to a front loading frame on rail display system in which a support rail is secured to a wall and display frames are secured to the rail.

Conventional display frames for photographs, artwork, and the like are formed by a rectangular frame into which a pane of glass, a sheet of graphic material to be displayed such as a photograph or artwork, and a backing panel are loaded, all from the rear side of the frame. The assembly may also include one or more sheets of border matting. The materials are retained within the frame by a rearward facing shoulder on the frame members which engage the glass pane and by retainer tabs, wire retainers, staples, or the like which engage the rear side of the frame members and the materials. Conventional framed mirrors may be assembled in a similar manner, typically loaded from the rear side of the frame.

Conventional display frames are mounted on a wall by a wire or similar member which extends across the rear side of the assembly between the side frame members to which the wire is attached. A picture hanger hook is nailed to the wall on which the frame is to be mounted. With large or heavy frames, two or more hooks may be nailed to the wall in horizontal alignment. The frame assembly is removably secured to the wall with the wire received in the hook or hooks, and it may be adjusted to level the top and bottom frame members. Smaller frames may be mounted on a wall by a hanger bracket which is fastened to the top frame member which is engaged with a picture hanger hook or possibly a nail protruding from the wall.

Other configurations of display framing are known. There are framing structures available for displaying pluralities of graphic material in a single structure. There are various arrangements for front loading display materials, matting, and a sheet of glass. There other configurations of display framing which are adapted for side, top, or bottom loading of displayed materials.

SUMMARY OF THE INVENTION

The present invention provides embodiments of an improved framing system for displaying graphic materials in which a front loaded display frame assembly is secured to a support rail which, in turn, is secured to a wall.

In an embodiment of the frame system, a display frame structure comprises a display frame assembly having a fastener extending therefrom; a frame support rail adapted for securing to a wall and having a support surface and an outer surface; a lock member positioned within the support rail and movable between a release position and a lock position; the display frame assembly engaging the support surface of the support rail with the fastener engaging the lock member in its release position; and the lock member being moved to the lock position to engage the fastener to releasably secure the display frame assembly to the support rail.

In an embodiment of the frame system, the display frame assembly is three sided and rectangular with a pair of side frame members depending from a top frame member. Each of the side frame members has a fastener extending from its lower end. The fasteners have heads on their lower ends which are engaged by lock members mounted in the support rail. In an embodiment of the system, the lock member is a cylindrical rotary lock member which is rotatable between the release position in which fastener can be received in the lock member and a lock position in which the lock member engages the head of the fastener. It is also foreseen that an embodiment of the frame system according to the present invention could be configured with a display frame assembly having a fourth frame member, with fasteners extending from one of the frame members, such as a lower frame member. It is also foreseen that the lock members could be positioned in bores in the frame member to engage fasteners extending from the support-rail.

In an embodiment of the frame system, the display frame assembly is closed by a rear panel and open toward the front of the frame to receive the material to be displayed. Each frame member has at least one retainer clip with a notch opening inwardly, toward a central area of the frame. The notches of the clips are aligned in a common plane to receive a planar "viewing panel". The viewing panel may be a pane of glass, a mirror, or the like. The viewing panel can also be a rigid panel of artwork. In most instances, the viewing panel is a pane of glass. Typically, a graphical sheet, such as piece of artwork, a photograph, or the like, is positioned between the rear panel and the glass pane and may also include one or more layers of peripheral or border matting. If needed, spacer matting can be positioned between the rear panel and the graphical sheet so that the layers fill the space between the rear panel and the glass pane. When all the layers have been inserted in the frame from the front, the glass pane is slid into the aligned notches of the retainer clips from the open side of the frame assembly. The window pane may be beveled on the top and side edges or, alternatively, on all four sides. The display frame assembly, thus loaded, is positioned on the support rail, and the lock members are moved to their lock positions to releasably secure the display frame assembly to the support rail.

In an embodiment of the frame system, the frame support rail is implemented as a frame support rail assembly. The rail assembly includes an elongated wall rail or board having a top bead and a front groove. A top rail or board having a bottom groove is positioned on top of the wall rail with the top bead of the wall rail received in the bottom groove of the top rail. It is foreseen that the bead could, alternatively, be formed on a lower surface of the top rail and the groove formed in the upper surface of the wall rail. The top rail may be secured to the wall rail by gluing, by fasteners such as screws, or by a combination thereof.

The top rail has a top surface which functions as the support surface for the display frame assembly and a front surface through which the lock members are accessed. The top rail has lock member receiving bores formed therethrough horizontally at locations spaced apart to align with the fasteners extending from the side members of the display frame assembly. Fastener receiving apertures are formed through the top surface of the top rail and communicate with the lock receiving bores. The rotary lock members are positioned within the bores, rotatable therein, and are accessible through the front surface of the top rail. In an embodiment of the frame system, the rotary lock members are substantially cylindrical in shape and hollow, with a fastener engaging slot formed in an outer cylindrical wall thereof. An end of lock member has a non-slip tool receiving formation, such as a Phillips recess, a Torx recess, or the like, formed therein.

The subassembly of the wall rail and top rail are secured to a wall, as by screws extending through the wall rail and into studs, or other substantial frame members, of the wall. The support rail assembly is completed by an apron crown molding having a bead extending therealong which is positioned in a groove formed along the wall rail. It is foreseen that the bead and groove could be provided on the opposite members from that described. Preferably, the bead and groove are sized for a frictional fit to retain the crown molding on the wall rail. The crown molding may also have end caps or end return stubs which engage the ends of the wall rail and which are flush with the ends of the top rail.

After the support rail assembly has been secured to in a desired location on a wall, rotary lock members are rotated to their release positions, and the display frame assembly, with display materials and glass panel inserted, is placed on the top rail with the fasteners positioned in the lock members. The lock members are then rotated to their lock positions to secure the display frame assembly on the support rail assembly. The lock member bores may then be closed with decorative plugs to finish the display system.

In an embodiment of the display system, a support rail assembly is adapted to receive more than one display frame assembly, such as two, three, or more. The display frame assemblies may all be of the same size and shape or they may differ in size and shape, such as a large display frame assembly in the middle, with two smaller or narrower display frame assemblies on opposite sides of the middle display frame assembly. Other variations of relative size and shape of the display frame assemblies are foreseen.

Although embodiments of the frame system of the present invention are described in which the support rail is oriented horizontally with display frame assemblies supported on a top surface of the support rail, it is foreseen that embodiments of the system could be configured in which a display frame assembly engages a lower surface of the support rail or both an upper surface and a lower surface of a support rail. Additionally, it is foreseen that embodiments of the system could be configured in which the display frame is oriented vertically with a display frame supported on one or both side surfaces of the support rail. Finally, it is foreseen that a support rail could be oriented angularly with a display frame supported on one or both sides of the support rail.

Various objects and advantages of the present invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

BRIEF DESCRIPTION OF THE DRAWINGS

FIG. 5 is an enlarged perspective view of a fastener and cam lock employed in the present invention, shown in a release position thereof.

FIG. 6 is a view similar to FIG. 5 and illustrates the fastener and cam lock with the cam lock shown in a lock position thereof.

FIG. 7 is a front elevational view of an embodiment of the display system and illustrates a single support rail assembly supporting a plurality of display frame assemblies.

DETAILED DESCRIPTION OF THE INVENTION

Figure 1:
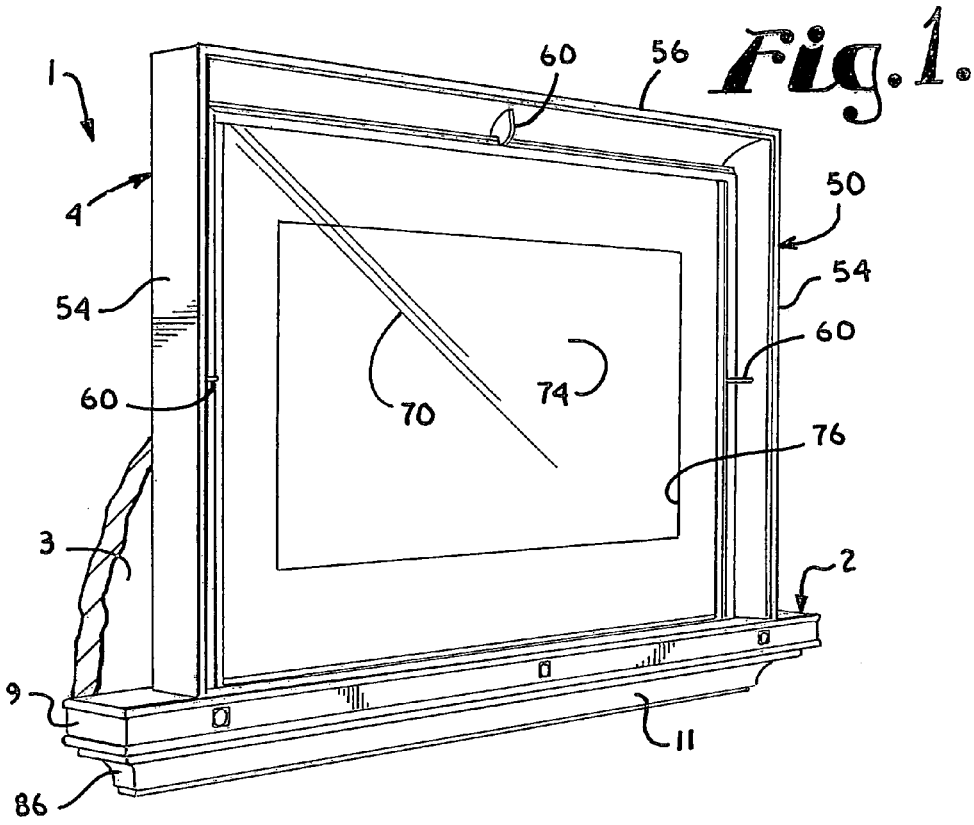
FIG. 1 is a perspective view of an embodiment of the front loading frame on rail display system according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates an embodiment of a front loading frame on rail display system according to the present invention. The system 1 generally includes a support rail assembly 2 secured to a wall 3 and supporting a front loading display frame assembly 4.

Figure 3:
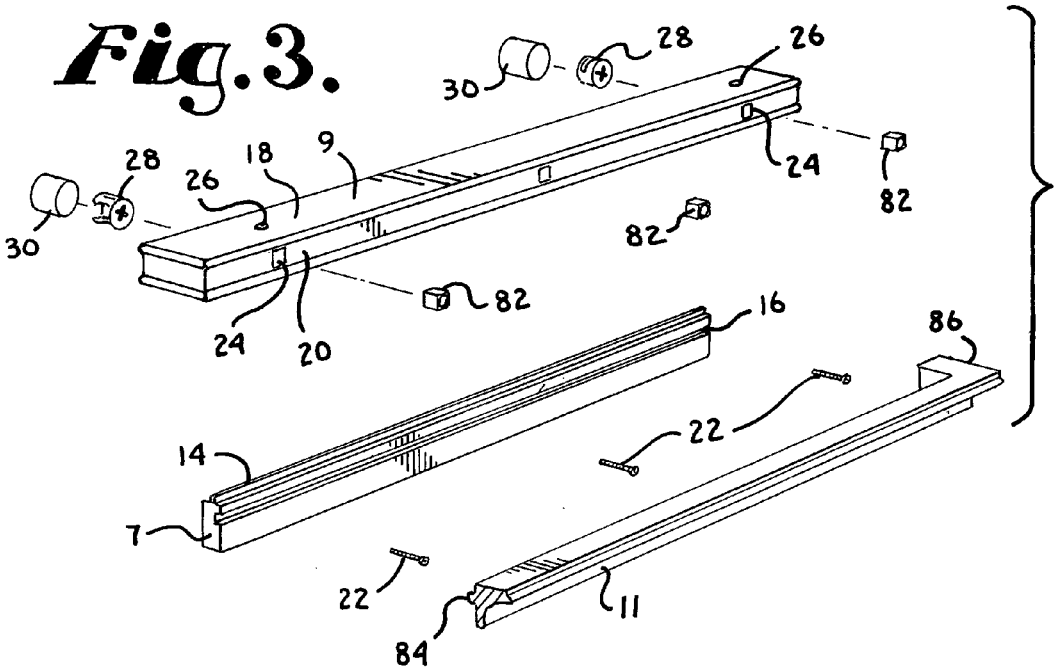
FIG. 3 is an exploded perspective view of an embodiment of a support rail assembly according to the present invention.

Referring to FIG. 3, the illustrated support rail assembly 2 includes a wall rail 7, a top support rail 9, and an apron crown molding 11. In general, the support rail 9 is secured to the wall rail 7, and the combination is secured to the wall 3. The molding 11 is then placed on the wall rail 7 below the support rail 9 to finish the support rail assembly 2. The illustrated wall rail 7 is an elongated wooden rail with a top bead 14 extending along an upper surface thereof and a groove 16 extending along a front surface thereof. The illustrated support rail 9 is an elongated wooden rail having a top support surface 18 and a front surface 20. The support rail 9 has a groove (not shown) in a lower surface (not shown) thereof which receives the bead 14. The top rail 9 is secured to the wall rail 7 by glue, by fasteners such as screws, or by a combination of glue and fasteners. The subassembly of the wall rail 7 and top rail 9 is secured to the wall 3, as by wall rail screws 22 which are received through the wall rail 7.

The illustrated top rail 9 has lock bores 24 formed through the front surface 20 parallel to the support surface 18 at positions spaced along the top rail 9. Each lock bore 24 has a fastener receiving or top aperture 26 which is formed through the top surface 18 in communication therewith. Each lock bore 24 has a rotary lock member 28 rotatably received therein. The lock bores 24 may be formed all the way through the top rail 9 to receive the lock members 28. Rear ends of the lock bores 24 may then be closed with rear plugs 30.

Referring to FIGS. 5 and 6, an exemplary rotary lock member 28 is generally cylindrical in shape with a partial outer cylindrical wall 34 closed on a front end by a flat front face 36 having a non-round recess 38 to receive a tool, such as a screwdriver or the like. The illustrated recess 38 is a cruciform Phillips recess. An end of the lock member 28 opposite the front face 36 may be, at least, partially closed (not shown) for structural integrity of the lock member 28. The cylindrical wall 34 has a fastener engaging slot 40 formed therein which terminates in an opening or gap 42. The wall thickness of the wall 34 may progressively increase to thereby increasingly engage, or to act as a cam to, the head 44 of a fastener 46 received through the gap 42, as will be described further below. The illustrated fastener 46 has an enlarged center section 45, a threaded screw end 47, and the enlarged head 44 spaced from the center section 45 by a shaft 48. The head 44 may include a driver slot 49 to receive a driver tool. The rotary lock member 28 and fasteners 46 may, for example, be Minifix brand connectors manufactured by Hafele GmbH & Co. KG (www.hafele.com). Similar types of connectors are described in U.S. Pat. Nos. 4,518,278 and 5,211,497 which are assigned to Hafele companies and which are incorporated herein by reference.

Figure 2:
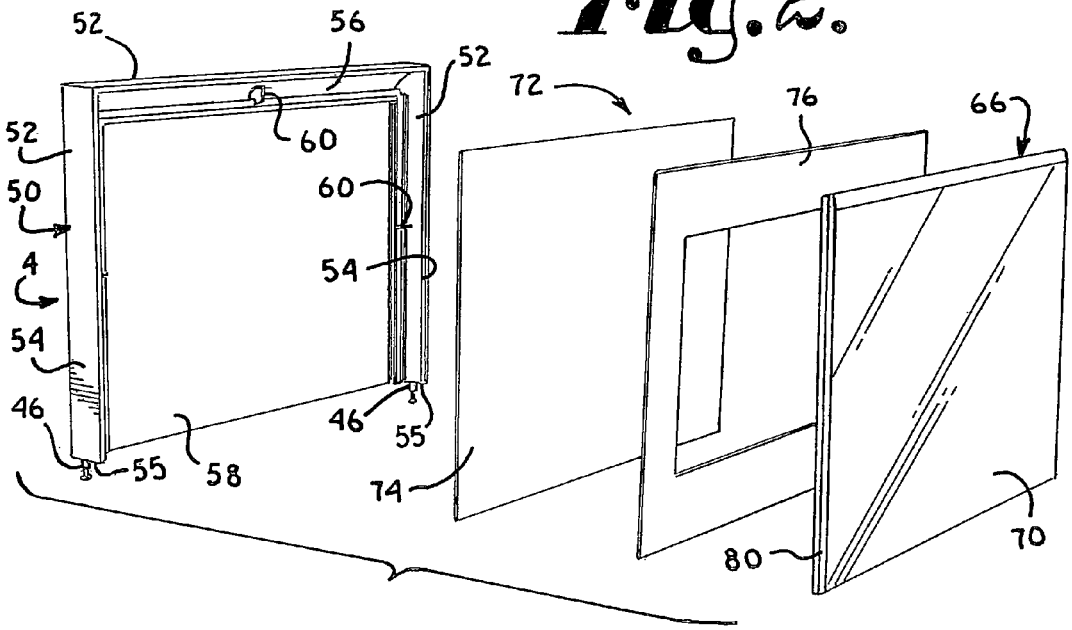
FIG. 2 is an exploded perspective view of an embodiment of a display frame assembly of the system.
Figure 4:
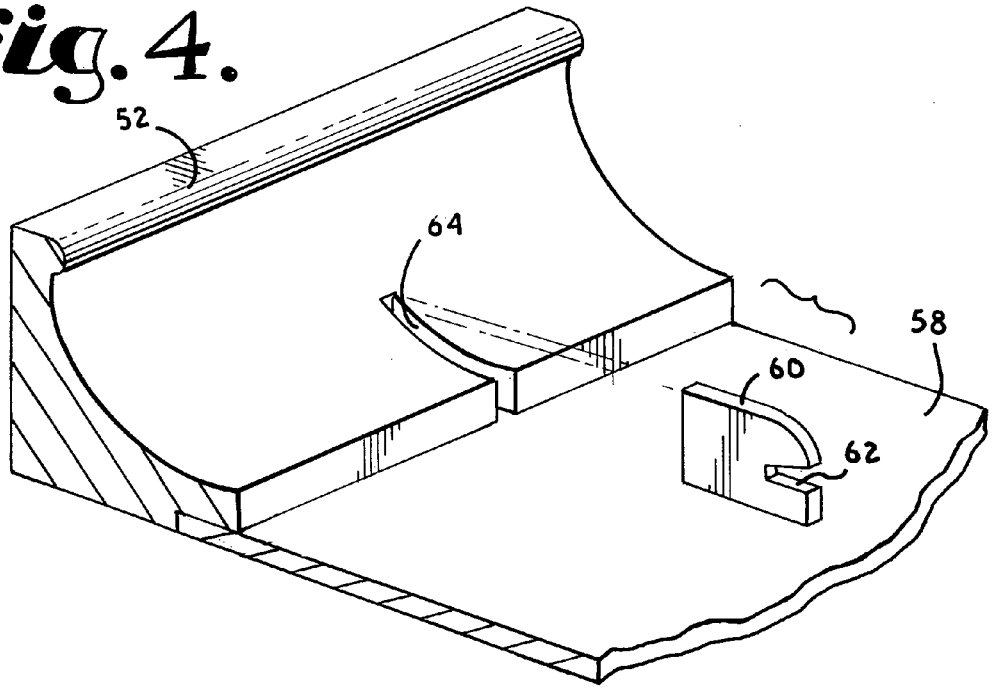
FIG. 4 is a greatly enlarged fragmentary perspective view of a section of a frame member and a glass clip member according to the present invention.

Referring to FIGS. 2 and 4, the illustrated display frame assembly 4 includes a frame unit 50 formed by frame members 52, including a pair of spaced apart, parallel side frame members 54 joined to a horizontally extending top frame member 56, as in miter joints. The illustrated frame members 52 are moldings which are generally beveled toward an inner area enclosed by the joined frame members 52. A rear side of the illustrated frame unit 50 is closed by a back panel 58, such as a sheet of wood or plywood, a wood fiber composite board, or a similar material. Each of the side frame members 54 has a fastener 46 screwed in a lower surface thereof 55 thereof and extends downwardly therefrom, terminating in the head 44 of the fastener.

Each of the frame members 52 has at least one viewing panel clip or glass clip 60 mounted therein, typically at the longitudinal center of the frame member 52. The illustrated clip 60 (FIG. 2) is formed of a relatively thin sheet material and has a notch 62 formed therein. Each clip 60 is positioned in slot 64 formed in an inner edge of the frame member 52. The clips 60 of a frame unit 50 are positioned so that the notches 62 thereof are aligned in a single plane to receive a planar viewing panel 66, as will be described below. The notches 62 of the clips 60 may be shaped to accommodate the thickness and shape of edges of the viewing panel 66, such as beveled edges.

The viewing panel 66 may be a mirror pane or a clear glass pane 70 through which planar display materials or elements 72 positioned within the frame unit 50 are viewed. The display materials 72 illustrated in FIG. 2 include a display sheet 74 and a sheet of border matting or mat 76. The display sheet 74 may be a photograph, a sketch, a drawing, a painting on a sheet of canvas or other medium, a print, a poster, or other kind of graphic material to be displayed. The illustrated mat 76 is provided with a single opening 78; however, it is foreseen that the mat 76 could be provided with multiple openings 78 to display multiple images mounted on the display sheet 74. The display materials may include a plurality of mats 76 with openings 78 having stepped down areas to create an appearance of depth in the frame unit 50. It is desirable that the display materials 72 fit snugly between the front surface of the back panel 58 and the rear surface of the glass pane 70. Therefore, one or more spacer panels (not shown) may be included in the display materials. Such spacer panels may be similar to the mat 76. The illustrated glass pane 70 has beveled edges 80. The beveled edges 80 may be provided on the top and sides of the pane 70 as shown or, alternatively, on all four sides. The notches 62 of the glass clips 60 are preferably shaped to accommodate the beveled edges 80 of the pane 70.

When the display frame assembly 4 is assembled, the display materials 72 are front loaded into the frame unit 50 in their proper order, then the glass pane 70 is slid into the notches 62 of the clips 60 from the lower or open side of the assembly 4. The display materials 72 and pane 70 are held in place as the ends of the fasteners 46 are aligned with and inserted into the top apertures 26 of the lock bores 24 of the top rail 9, with the lock members 28 rotated to release positions in which the gaps 42 thereof are oriented upwardly. The lock members 28 are then rotated to their lock positions in which the edges of the slots 40 engage the enlarged heads 44 of the fasteners 46. Front ends of the lock bores 24 may then be closed by front plugs 82 which are inserted through the front surface 20 of the top rail 9.

The illustrated apron crown molding 11 is provided with an elongated bead 84. The molding 11 is engaged with the wall rail 7 by inserting the bead 84 into the groove 16 of the wall rail 7. It is foreseen that the bead 84 and groove 16 could provided on the opposite members to that described. The illustrated molding 11 has end pieces 86 (FIGS. 1 and 3) which cover the ends of the wall rail 7 (FIG. 3). The molding 11 covers the fasteners 22 of the wall rail 7 and provide a finished appearance to the display system 1. The top rail 9 may have and an increased width and the top apertures 26 may be positioned in such a manner as to space the display frame assembly 4 out from the wall 3 to give an appearance of greater depth to the display system 1. Additionally, the top rail 9 may have enough width in front of the display frame assembly 4 to form a shelf (not shown) which may receive decorative articles (not shown). This may be especially appropriate when the viewing panel 66 is a mirror.

FIG. 7 illustrates a multiple frame embodiment 90 of the display system 1 according to the present invention. The multiple frame display system 90 includes an elongated support rail assembly 92 configured in a manner substantially similar to the support rail assembly 2. The system 90 includes a plurality of display frame assemblies 94 which are supported on the rail assembly 92. Each of the frame assemblies 94 is configured in a manner substantially similar to the display frame assembly 4. The illustrated display system 90 includes a large, horizontally rectangular center display frame assembly 96 and a pair of outboard, vertically rectangular display frame assemblies 98. The frame assemblies 94 could all be similar in size and shape, or they may be different. Different numbers of frame assemblies 94 can be supported by the rail assembly 92 than the three shown. Therefore, variations from the illustrated number, sizes, and shapes of the display frame assemblies 94 are intended to be encompassed by the present invention. The frame assemblies 94 may be secured to the support rail assembly 92 in a manner substantially similar to the way in which the display frame assembly 4 is secured to the support rail assembly 2.

It is to be understood that while certain forms of the present invention have been described and illustrated herein, it is not to be limited to the specific forms or arrangement of parts described and shown.

What is claimed and desired to be secured by Letters Patent is:

1. A display frame structure comprising:

(a) a display frame assembly;

(b) a frame support rail adapted for securing to a wall, said rail having a support surface;

(c) a fastener extending from one of said display frame assembly and said support rail and terminating in a fastener head;

(d) a rotary lock member positioned within the other of said support rail and said display frame and rotatable between a release position disengaged from said fastener head and a lock position engaging said fastener head;

(d) said display frame assembly engaging said support surface of said support rail with said lock member in said release position thereof; and (e) said lock member being rotated to said lock position to engage said fastener head to releasably secure said display frame assembly to said support rail.

2. A structure as set forth in claim 1 and including:

(a) a lock member bore formed into said support rail and communicating with a fastener receiving aperture opening through said support surface;

(b) said lock member being positioned within said lock member bore and rotatable between said release position and said lock position;

(c) said fastener extending from said display frame and being received into said fastener receiving aperture with said lock member in said release position; and (d) said lock member being rotated to said lock position to thereby releasably secure said display frame assembly to said support rail.

3. A structure as set forth in claim 1 wherein:

(a) said support rail has an outer surface; and (b) said lock member is positioned in said support rail and is accessible through said outer surface.

4. A structure as set forth in claim 1 wherein:

(a) said display frame assembly includes a pair of spaced apart depending side members, each side member terminating in a side member end;

(b) a respective fastener extends from each side member end; and (c) a respective lock member is associated with each fastener and is positioned within said support rail to align with the associated fastener.

5. A structure as set forth in claim 1 wherein:

(a) said display frame assembly is formed by a plurality of frame members including a pair of spaced apart side frame members having spaced apart side member ends;

(b) each of said side member ends includes a respective fastener extending therefrom;

(c) each frame member includes a retainer clip extending inwardly therefrom, said retainer clip having an inwardly opening notch formed therein, the notches of the retainer clips of said frame members being aligned in a common plane; and (d) a planar viewing panel is positioned within said frame assembly and within the aligned notches.

6. A structure as set forth in claim 5 wherein:

(a) each of said frame members has said retainer clip positioned on a front side thereof.

7. A structure as set forth in claim 1 wherein said display frame assembly includes:

(a) a planar viewing panel positioned therein from a front side thereof.

8. A structure as set forth in claim 1 wherein said display frame assembly is a first display frame assembly having a first fastener extending therefrom, and including:

(a) a second display frame assembly having a second fastener extending therefrom;

(b) a first lock member and a second lock member positioned within said support rail and movable between a release position and a lock position;

(c) said second display frame assembly engaging said support surface of said support rail with said second lock member in the release position thereof; and (d) said lock members being moved to the lock position thereof to releasably secure said second display frame assembly to said support rail.

9. A display frame structure comprising:

(a) a display frame assembly including a pair of spaced apart depending side members, each side member terminating in a side member end, said side member ends being aligned;

(b) a respective fastener extending from each side member end, said fastener terminating in a fastener head;

(c) an elongated frame support rail adapted for securing to a wall, said rail having an upwardly facing support surface and an outer surface;

(d) a lock member bore associated with each side member formed into said outer surface and communicating with a respective fastener receiving aperture opening through said support surface;

(e) a rotary lock member positioned within each lock member bore and rotatable between a release position disengaged from the head of a respective fastener and a lock position engaged with said head of a respective fastener;

(f) said display frame assembly engaging said support rail with the side member ends engaging said support surface and with the fasteners received in the respective fastener receiving apertures with each of the lock members in the release position thereof; and (g) each lock member being rotated to the lock position thereof to thereby engage a corresponding fastener head to releasably secure said display frame assembly to said support rail.

10. A structure as set forth in claim 9 wherein:

(a) said display frame assembly includes a top member having said side members depending from ends thereof;

(b) each frame member includes a retainer clip extending inwardly therefrom, said retainer clip having an inwardly opening notch formed therein, the notches of the retainer clips of said frame members being aligned in a common plane; and (c) a planar viewing panel is positioned within said frame assembly and within the aligned notches.

11. A structure as set forth in claim 10 wherein:

(a) each of said frame members has said retainer clip positioned on a front side thereof.

12. A structure as set forth in claim 9 wherein said display frame assembly includes:

(a) a planar viewing panel positioned therein from a front side thereof.

13. A structure as set forth in claim 9 wherein said display frame assembly is a first display frame assembly, and including:

(a) a second display frame assembly substantially similar to said first display frame assembly and having a second fasteners extending therefrom;

(b) second lock members positioned within said support rail, each being rotatable movable between a release position and a lock position thereof;

(c) said second display frame assembly engaging said support surface of said support rail with said second lock members in the release positions thereof; and (d) said second lock members being moved to the lock positions thereof to releasably secure said second display frame assembly to said support rail.

14. A display frame structure comprising:

(a) an elongated frame support rail adapted for securing to a wall, said rail having a support surface;

(b) a display frame assembly formed by a plurality of frame members including a pair of spaced apart side frame members having spaced apart side member ends;

(c) each frame member having a retainer clip extending inwardly therefrom on a front side thereof, said retainer clip having an inwardly opening notch formed therein, the notches of the retainer clips of said frame members being aligned in a common plane;

(d) a planar viewing panel positioned within said frame assembly and within the aligned notches; and (e) said frame assembly with said viewing panel therein being secured to said support rail on said support surface and by securing said side member ends to said support rail.

15. A structure as set forth in claim 14 wherein:

(a) each of said frame members has said retainer clip positioned on a front side thereof.

16. A structure as set forth in claim 14 and including:

(a) said planar viewing panel being positioned within said display frame assembly from a front side thereof.

17. A structure as set forth in claim 14 wherein:

(a) a respective fastener extends from each side member end;

(b) a respective lock member is associated with each fastener and is positioned within said support rail to align with the associated fastener, said lock member being movable between a release position and a lock position;

(c) said display frame assembly engages said support rail with said side member ends engaging said support surface and with the fasteners received in the lock members with the lock members in the release position thereof; and (d) each lock member is moved to the lock position thereof the thereby releasably secure said display frame assembly to said support rail.

18. A structure as set forth in claim 17 wherein:

(a) each of said lock members is a rotary lock member which is rotatable between said release position and said lock position.

19. A structure as set forth in claim 14 wherein said display frame assembly is a first display frame assembly, and including:

(a) a second display frame assembly substantially similar to said first display frame assembly; and (b) said second display frame assembly being secured to said support rail in spaced relation to said first display frame assembly.

20. A display frame structure comprising:

(a) a display frame assembly formed by a plurality of frame members including a pair of spaced apart side frame members having spaced apart side member ends;

(b) each of said side member ends having a fastener extending therefrom, each of the fasteners terminating in a fastener head;

(c) each frame member having a retainer clip extending inwardly therefrom, said retainer clip having an inwardly opening notch formed therein, the notches of the retainer clips of said frame members being aligned in a common plane;

(d) a planar viewing panel positioned within said frame assembly and within the aligned notches;

(e) an elongated frame support rail adapted for securing to a wall, said rail having a support surface and an outer surface;

(f) a respective lock member associated with each of said fasteners, each lock member being positioned within said support rail, accessible from said outer surface, and movable between a release position disengaged from the head of a respective fastener and a lock position engaged with said head of a respective fastener;

(g) said display frame assembly with said viewing panel therein engaging said support surface of said support rail with the lock members in said release position thereof; and (h) each of said lock members being moved to said lock position thereof to engage the fastener head of the associated fastener to releasably secure said display frame assembly to said support rail.

21. A structure as set forth in claim 20 wherein:

(a) each lock member is a rotary lock member rotatable between said release position and said lock position.

22. A structure as set forth in claim 20 wherein:

(a) each of said frame members has said retainer clip positioned on a front side thereof; and (b) said planar viewing panel is positioned in said display frame assembly from a front side thereof.

23. A structure as set forth in claim 20 wherein said display frame assembly is a first display frame assembly, and including:

(a) a second display frame assembly substantially similar to said first display frame assembly and having a second fasteners extending therefrom;

(b) second lock members positioned within said support rail, each being rotatable movable between a release position and a lock position thereof;

(c) said second display frame assembly engaging said support surface of said support rail with said second lock members in the release positions thereof; and (d) said second lock members being to the lock positions thereof to releasably secure said second display frame assembly to said support rail in spaced relation to said first display frame assembly.

* * * * *